US007868856B2

(12) United States Patent
Fish

(10) Patent No.: US 7,868,856 B2
(45) **Date of Patent: *Jan. 11, 2011**

(54) DATA SIGNAL DRIVER FOR LIGHT EMITTING DISPLAY

(75) Inventor: David A. Fish, Haywards Heath (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 1026 days.

This patent is subject to a terminal disclaimer.

(21) Appl. No.: 10/569,177

(22) PCT Filed: Aug. 20, 2004

(86) PCT No.: PCT/IB2004/002729

§ 371 (c)(1),
(2), (4) Date: Feb. 22, 2006

(87) PCT Pub. No.: WO2005/022500

PCT Pub. Date: Mar. 10, 2005

(65) Prior Publication Data

US 2006/0261841 A1 Nov. 23, 2006

(51) Int. Cl.
*G09G 3/30* (2006.01)
*G09G 3/34* (2006.01)
*G09G 5/10* (2006.01)

(52) U.S. Cl. ..... 345/78; 345/84; 345/690

(58) Field of Classification Search ..... 345/76–78, 345/82, 84, 204, 690; 315/169.3
See application file for complete search history.

(56) References Cited

U.S. PATENT DOCUMENTS

| | | | | |
|---|---|---|---|---|
| 5,751,279 | A | 5/1998 | Okumura | |
| 5,774,100 | A | 6/1998 | Aoki et al. | |
| 5,805,130 | A | 9/1998 | Yamamoto et al. | |
| 6,091,203 | A * | 7/2000 | Kawashima et al. | 315/169.3 |
| 6,229,508 | B1 | 5/2001 | Kane | |
| 7,071,635 | B2 * | 7/2006 | Inoue et al. | 315/366 |
| 7,164,417 | B2 * | 1/2007 | Cok | 345/207 |
| 7,319,444 | B2 * | 1/2008 | Jo | 345/76 |
| 2002/0180672 | A1 | 12/2002 | Yamazaki et al. | |
| 2002/0186192 | A1 | 12/2002 | Maruoka et al. | |
| 2003/0034941 | A1 | 2/2003 | Janssen et al. | |

* cited by examiner

*Primary Examiner*—Bipin Shalwala
*Assistant Examiner*—Keith Crawley

(57) ABSTRACT

A display has light emitting elements (2) arranged in rows and columns, with pixels in a column being supplied with current from a respective column power supply line (26). Target pixel drive currents are determined corresponding to desired pixel brightness levels based on a model of the pixel current-brightness characteristics. These are modified to take account of the voltage on the column power supply line (26) at each pixel resulting from the currents drawn from the column power supply line, and the dependency of the pixel brightness characteristics on the voltage on the column power supply line at the pixel. The invention addresses the problem of vertical cross-talk that occurs in active matrix LED displays due to the finite output impedance of the current providing TFTs as well as the finite resistance of metals used to form power supply lines.

17 Claims, 6 Drawing Sheets

DATA SIGNAL DRIVER FOR LIGHT EMITTING DISPLAY

This invention relates to light emitting display devices, for example electroluminescent displays, particularly active matrix display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

The polymer material can be fabricated using a CVD process, or simply by a spin coating technique using a solution of a soluble conjugated polymer. Ink-jet printing may also be used. Organic electroluminescent materials exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-driven display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase.

FIG. 1 shows a known pixel circuit for an active matrix addressed electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice, there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support.

FIG. 2 shows in simplified schematic form a known pixel and drive circuitry arrangement for providing voltage-programmed operation. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended. The drive transistor 22 draws a current from the power supply line 26.

The drive transistor 22 in this circuit is implemented as a p-type TFT, so that the storage capacitor 24 holds the gate-source voltage fixed. This results in a fixed source-drain current through the transistor, which therefore provides the desired current source operation of the pixel.

The invention is concerned particularly with pixel configurations in which the power supply lines 26 are parallel to the column conductors 6, for example formed from the same metal layer. This metal layer is typically the top metal of the fabrication process, which can be thicker and therefore less resistive than the bottom metal layer usually used for forming the row conductors. The length of the power line is also then shorter for landscape displays.

If the pixel circuit of FIG. 2 is modified to use vertical power lines, it will suffer severe cross-talk. In particular, the pixel operates by shutting off current supply to the display element while the data is stored in the pixel, and the data voltage stored is a voltage which is relative to the power supply line voltage. The data voltage will be corrupted by power supply line voltage drops caused by other pixels in the power column which are still drawing current along the resistive power line.

Current mirror circuits do not suffer this drawback, as the power supply to the pixel can be continuous and does not need to be interrupted. For this reason, current mirror circuits are typically used for implementing pixel configurations with vertical power supply lines.

There are two basic types of current mirror circuit. A switched current mirror circuit samples a current from the data conductor and can be arranged to draw the same current from the data conductor during pixel programming as during display. However, the complexity of such pixel circuits makes them unsuitable for large displays.

A matched current mirror circuit draws current for a sampling transistor and the drive transistor during a pixel programming phase so that the pixel programming phase alters the voltages on the power supply line. Although the pixels sample the current (so that the pixel output is not directly related to the voltage on the power supply line), a second order cross talk effect remains, as will become apparent from the discussion below.

FIG. 3 shows a matched current mirror circuit. In this circuit, the column conductor 6 is coupled to a controllable current source 30. During pixel addressing, an address transistor 32 is turned on and the current drawn by the current source 30 is sourced by a current sampling transistor 34. A further transistor 36 is controlled by the same control line 38 as the address transistor 32, and provides that the gate of the sampling transistor and the gate of the drive transistor 22 are at the same voltage during addressing. As the source of these transistors are both connected to the power supply line 26, the source voltages and the gate-source voltages are the same. Thus, the current in the drive transistor mirrors the current in the sampling transistor.

If the sampling and drive transistors 34,22 have the same dimensions, the same current will be drawn, and the power supply line 26 will source double the current of the current source 30 during the addressing phase. In a more general case, the dimensions of the sampling transistor 34 and the drive transistor 22 may be different, so that the current mirror performs an amplification. In this case, the current drawn from the power supply line 26 will be taken to be $(1+W)I_D$ where $I_D$ is the drive transistor current. W is a scaling factor for example based on the ratio between the channel widths of the two transistors. For identical matched transistors, W=1, and the current drawn is $2I_D$. At all other times, the current drawn from the power supply line is $I_D$.

The problem remains in the pixel circuit of FIG. 3 that the thin film transistors are inherently non-ideal current source devices, as the output current will in fact depend on both the source and drain voltages rather than only on the gate-source voltage.

One problem with LED displays arises from the significant currents drawn by the pixels. The displays are typically backward-emitting, through the substrate carrying the active matrix circuitry. This is the preferred arrangement because the desired cathode material of the EL display element is opaque, so that the emission is from the anode side of the EL diode, and furthermore it is not desirable to place this preferred cathode material against the active matrix circuitry. Metal row or column conductors are formed to define the power supply lines 26, and for these backward emitting displays they need to occupy the space between display areas, as they are opaque. For example, in a 12.5 cm (diagonal) display, which is suitable for portable products, the power supply line conductor may be approximately 11 cm long and 20 μm wide. For a typical metal sheet resistance of 0.2 Ω/square, this gives a line resistance for a metal row conductor of 1.1 kΩ.

A bright pixel may draw around 8 μA, and the current drawn is distributed along the power supply line. The significant conductor resistance gives rise to voltage drops along the power supply line. This is a problem both for voltage-addressed pixels and current-addressed pixels.

Voltage drops along the power supply line mean that the drain-source voltage of the current-providing TFT will be reduced. The finite output impedance of the current-providing TFT then results in a reduction in its current. This change in current will again depend upon the current being drawn from all of the other pixels in the column, the TFT output impedance for the particular operating conditions, and the OLED I-V characteristic. In particular, the consequent changes in the anode voltage of the OLED display element will alter the brightness output of the display element for a given current sampled by the circuit. Therefore, a second order vertical cross-talk will occur because of the finite output impedance of the OLED driving TFT 22. This second order cross talk can still give visible cross-talk in large displays.

According to the invention, there is provided a method of determining the pixel drive signals to be applied to the pixels of an array of light emitting display elements arranged in rows and columns, with a plurality of the pixels in a column being supplied with current from a respective column power supply line and the pixels being addressed row by row, the addressing of all rows defining a field period, the method comprising:

determining target pixel drive currents corresponding to desired pixel brightness levels based on a model of the pixel current-brightness characteristics;

modifying the target pixel drive currents to take account of:

the voltage on the column power supply line at each pixel resulting from the currents drawn from the column power supply line by the plurality of pixels in the column for each row addressing cycle in a field period; and the dependency of the pixel brightness characteristics on the voltage on the column power supply line at the pixel.

By taking into account the dependency of the pixel brightness characteristics on the voltage on the power supply line at the pixel, the invention addresses the problem of vertical cross-talk that occurs in active matrix LED displays due to the finite output impedance of the current providing TFTs as well as the finite resistance of metals used to form power supply lines. The invention provides a signal processing scheme for correction of the cross-talk. The model used to form the target drive currents can assume a constant voltage on the power supply line, and is thus a constant model for all pixels and independent of the pixel drive signals applied to other pixels.

The compensation for the dependency of the pixel brightness characteristics on the voltage on the power supply line essentially takes into account the change in the operating point of the pixel components (for example the drain voltage of the drive transistor in the pixel configuration of FIG. 3).

The technique of the invention is applicable to amorphous silicon and polysilicon technologies for any array that uses column power lines which supply current to columns of current-drawing pixels. It should be noted that the terms "row" and "column" used herein are somewhat arbitrary, and these terms are merely intended to denote an array of device elements arranged in an orthogonal matrix. A "column" power supply line is orthogonal to the "rows" of pixels which are addressed in sequence.

Each pixel is preferably programmed in a first phase and driven in a second phase, and wherein the step of modifying the target pixel drive currents further takes account of any differences in the current drawn by the pixels between the first and second phases.

In particular, some pixel drive schemes involve supplying more or less current in the programming phase than during driving of the pixel. By taking this into account, correct compensation can be provided for any pixel drive scheme.

The step of modifying the target pixel drive currents may comprise:

applying an algorithm to the target pixel drive currents which represents:

the relationship between the currents applied to the pixels in a column during a field period and the voltages on the column power supply line at the locations of the pixels; and the dependency of the pixel brightness characteristics on the voltage on the column power supply line.

For example, applying an algorithm may comprise multiplying a vector of the target pixel drive currents for a column of pixels by the inversion of the matrix M, in which:

$$M = \begin{bmatrix} -2 & 1 & & & & \\ 1 & -2 & 1 & & & \\ & \iddots & \iddots & \iddots & & \\ & & 1 & -2 & 1 \\ & & & 1 & -2 \end{bmatrix},$$

and wherein the number of rows and columns of matrix M is equal to the number of pixels in the column.

Each pixel may comprise a current sampling transistor which samples an input current and provides a drive voltage to a drive transistor, and the algorithm then uses a value including terms derived from:

the voltage-current characteristics of the drive transistor; and the voltage-current characteristics of the light emitting display element.

In particular, the algorithm may also use a value including a term derived from the resistance of the column power supply line.

The algorithm may use a value $R\lambda/(1+\lambda/\mu)$, where

R is the resistance of the column power supply line between adjacent pixels;

$\lambda$ is the slope of the drain-source current vs. drain-source voltage curve of the drive transistor; and $\mu$ is the slope of the current vs. voltage curve of the display element.

In order to reduce the computational overhead, the result of multiplying a vector of the target pixel drive currents for a column of pixels by the inversion of the matrix M can be obtained by a recursive operation:

$$F(c, n) = F(c, n-1) + \sum_{j=0}^{n-1} I_{av}(c, j) + F(c, 0)$$

in which:

F(c,n) is the nth term of the vector result of multiplying the vector of the target pixel drive currents for the cth column of pixels by the inversion of the matrix M, F(c, 0) being the first term; and $I_{av}(c,j)$ is the target current for the jth pixel in the cth column, the first pixel being j=0.

In this recursive model:

$$F(c, 0) = \frac{-1}{N+1} \sum_{j=0}^{N-1} (N-j) I_{av}(c, j),$$

in which:

N is the total number pixels in the column.

The values representing the dependency of the pixel brightness characteristics on the voltage on the column power supply line can be stored in a look up table, and the values of the look up table can be updated over time to enable changes in pixel brightness characteristics over time to be modeled. For example, the look up table values can be updated based on analysis of the characteristics of pixel compensation modules of the display.

The method of the invention can be used for driving an active matrix array of current-addressed light emitting display elements arranged in rows and columns, in which each row of pixels is addressed in a sequence and power is supplied to each column of pixels using a column power supply line.

The invention also provides a display device comprising an array of light emitting display elements arranged in rows and columns, with a plurality of the pixels in a column being supplied with current from a respective column power supply line and the pixels being addressed row by row, the addressing of all rows defining a field period, the device further comprising:

compensation circuitry for modifying target pixel drive currents to take account of the voltage on column power supply line at each pixel resulting from the currents drawn from the column power supply line by the plurality of pixels in the column for each row addressing cycle in a field period and the dependency of the pixel brightness characteristics on the voltage on the row conductor at the pixel.

The compensation circuitry preferably comprises:

means for applying an algorithm to the target pixel drive currents which represents the relationship between the currents drawn by the pixels in a column and the voltages on the column power supply line at the locations of the pixels and the dependency of the pixel brightness characteristics on the voltage on the row conductor.

Examples of the invention will now be described in detail with reference to the accompanying drawings, in which.

Figure 1:
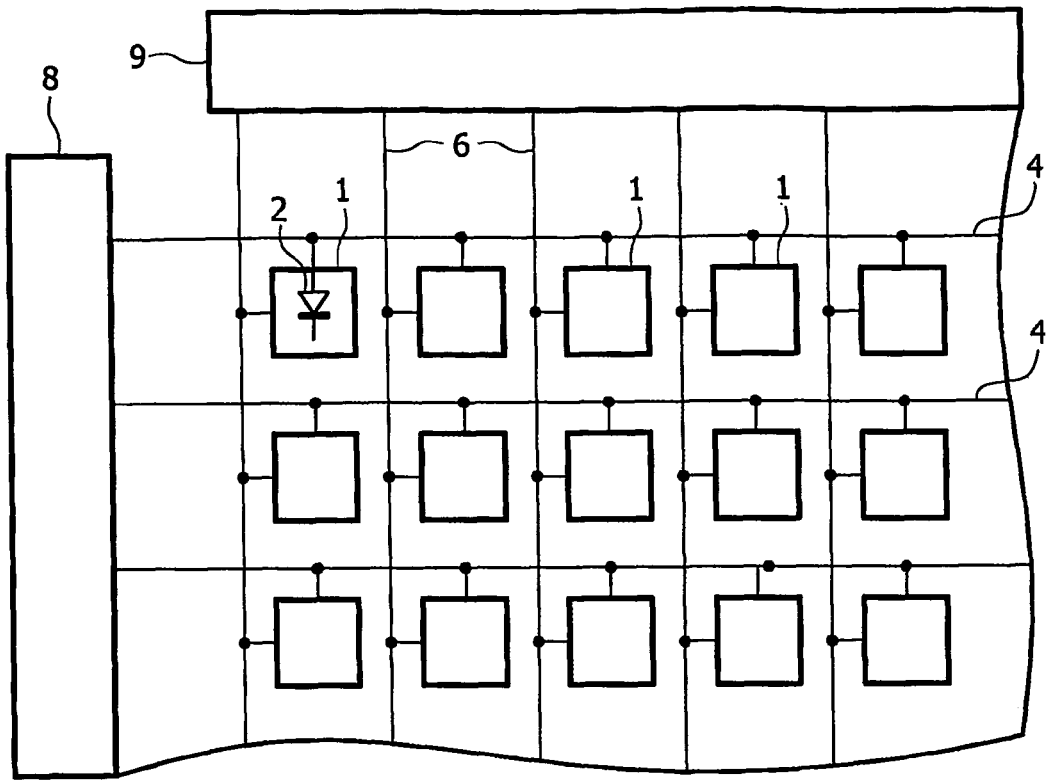
FIG. 1 PRIOR ART
FIG. 1 shows a conventional active matrix LED display.
Figure 2:
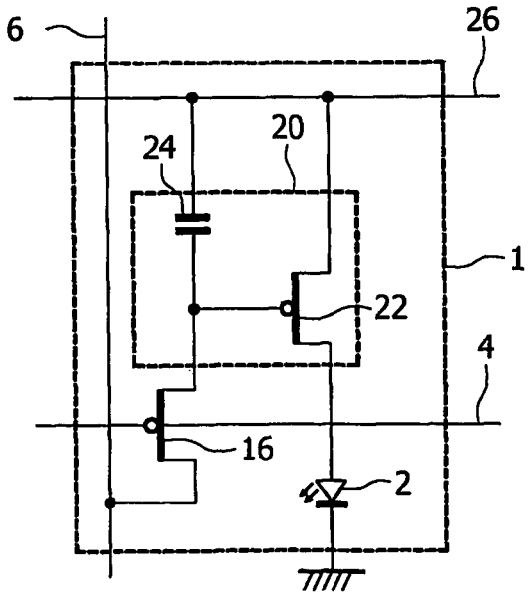
FIG. 2 PRIOR ART
FIG. 2 shows a first conventional pixel layout for the display of FIG. 1.

The invention provides a scheme for determining the pixel drive signals to be applied to the pixels of an array of light emitting display elements, using column power supply lines. A set of standard pixel drive currents, corresponding to desired pixel brightness levels, are modified to take account of the voltage variations on the column power line and particularly the effect these voltage variations have on the pixel brightness characteristics. The invention also takes into account the different currents drawn by a pixel when being addressed and when driving the display element, in particular for a current-addressed pixel which performs a sampling operation of an input current. The modification of the pixel drive currents is to correct for vertical cross-talk.

The invention is applicable to various pixel layouts, but most importantly to current-addressed pixels, as these are most frequently used in vertical power line arrangements.

A current-addressed pixel which performs a current sampling operation can be assumed to provide the desired output current immediately after addressing. However, subsequent changes in voltage on the power supply line will influence the current output of the pixel. These changes in voltage will result when other pixels in the column are addressed.

In order to derive an algorithm for the correction of this vertical cross-talk, the following steps are taken:

a general expression for voltage drops on the column power line is obtained, for any combination of currents drawn by the pixels in a column;

the effect of these voltage drops on the pixel output brightness is then determined, this effect being the result of the output impedance of the in-pixel current source TFT; and a correction scheme for the data is derived to compensate for the vertical cross talk.

To derive the correction algorithm, it is first necessary to calculate the average OLED current (not including addressing current) over a field time. This field time is the period of time between addressing phases for the row. The light output is proportional to this average current. It is given by:

$$I_{av}(r) = \frac{1}{N}\left[I(r) + \sum_{j=r+1}^{r+N-1} (\Delta I(r, j) + I(r))\right] \tag{1}$$

which can instead be written as:

$$I_{av}(r) = I(r) + \frac{1}{N}\left[\sum_{j=r+1}^{r+N-1} (\Delta I(r, j))\right] \tag{1a}$$

where I(r) is the OLED current when row r is addressed and ΔI(r,j) is the change in the OLED current on row r when row j is addressed (j can be viewed as a time sequence index). N is the number of rows and $I_{av}(r)$ is the average current supplied to the OLED on row r. The calculation is performed for one column only to reduce notational complexity, but every current in fact has a column index c as well as a row index r.

This equation assumes that the rows are addressed in order. Thus, when addressing row r, the rows 1 to (r−1) have already been addressed in that field period, whereas the rows (r+1) to N still draw currents from the previous addressing cycle. As the addressing is a cyclic operation, the first change in current will be seen when the next row (r+1) is addressed, which is the lower summation limit. The last change in current to be seen will be the preceding row (r−1) being addressed in the next field period. This is the addressing phase (r−1+N), which is the upper summation limit.

In order to find an expression for the pixel current changes due to the power line voltage drops and the output impedance of the in-pixel current-providing TFT, a simple diagrammatic approach can be used.

Figure 4:
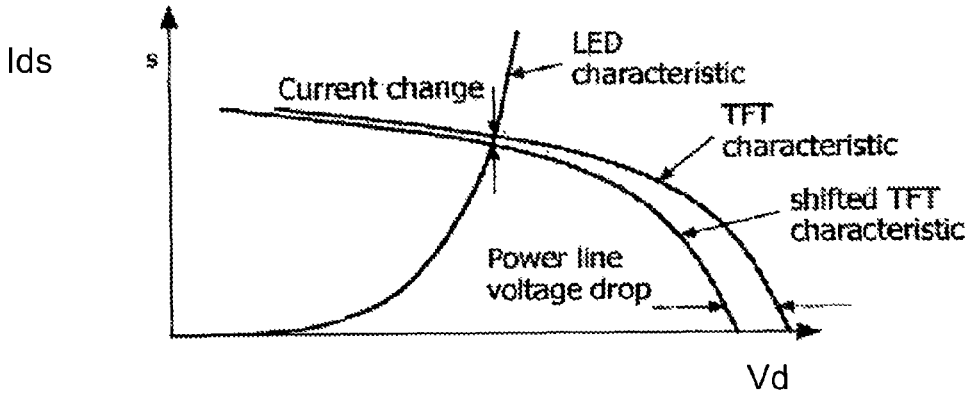
FIG. 4 is used to investigate the pixel output characteristics in response to changes in the power supply line voltage.

FIG. 4 shows the TFT and LED characteristics. The TFT characteristic curve plots the drain source current ($I_{ds}$) against the drain voltage ($V_d$) for a constant gate-source voltage. When the drain voltage reaches the column power line voltage, the drain-source voltage reaches zero. Thus, increasing voltage in the graph of FIG. 5 corresponds to decreasing drain-source voltage, and the drain-source voltage is zero at the point where the curve crosses the x-axis. This point on the x-axis corresponds to the power line voltage.

Figure 3:
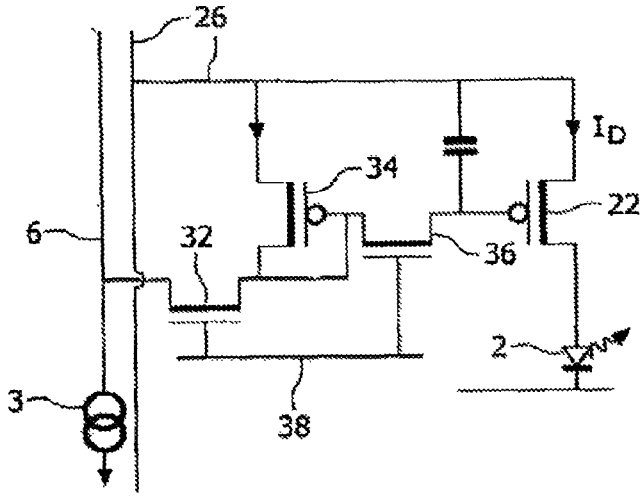
FIG. 3 shows a second conventional pixel layout for the display of FIG. 1 for use when vertical power lines are to be used.

The shift in the TFT characteristics is the result of the change in the power line voltage, assuming the gate-source voltage remains constant (as shown in FIG. 3, the gate-source voltage is stored on a capacitor).

The LED characteristic curve is a load line plot of the LED and shows the anode voltage of the LED display element for a given current.

Where the TFT characteristic curve crosses the LED characteristic curve, the drain/anode voltage is defined and the current flowing. As the TFT has a non-infinite output impedance when in saturation, movements in the power supply voltage shift the TFT characteristic to give different output currents, even for a constant gate-source voltage. Thus, the power line voltage change is not fully compensated in a current-addressed pixel.

Figure 5:
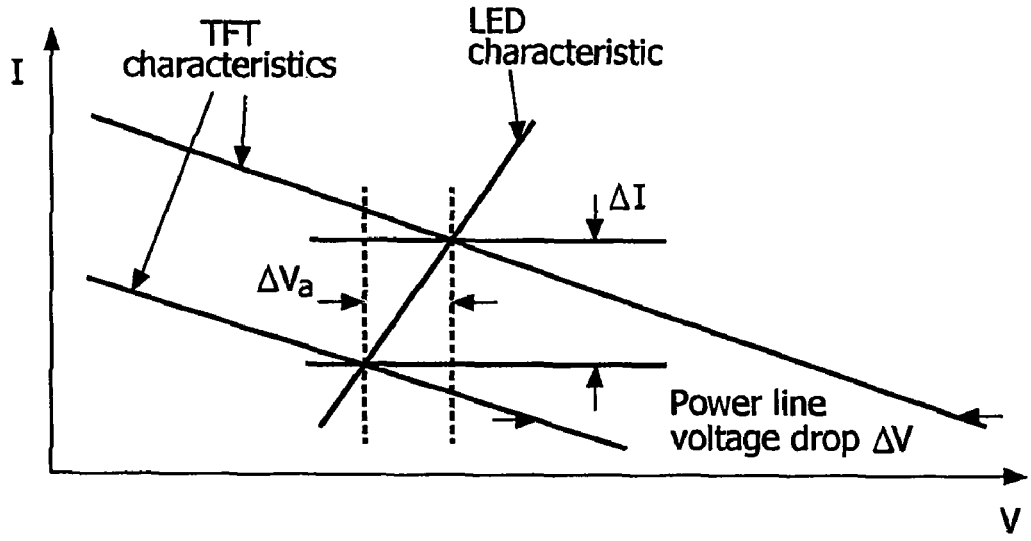
FIG. 5 shows a part of FIG. 4 in greater detail.

The region of current change shown in FIG. 5 can be examined more closely in order to determine the change in anode/drain voltage and the change in current. This is shown in FIG. 6.

Figure 6:
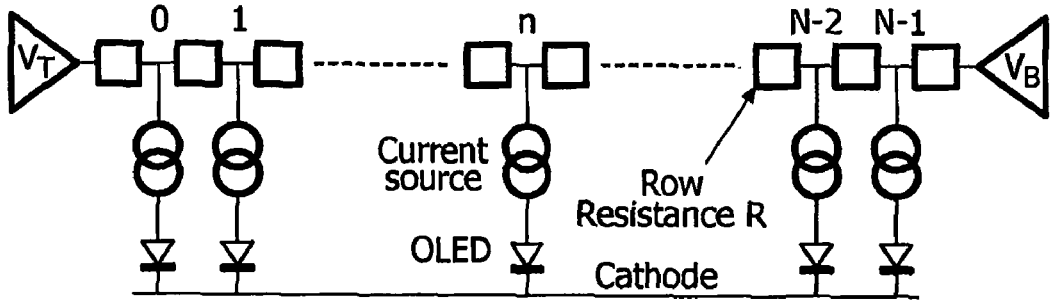
FIG. 6 is an equivalent circuit used to derive the relationship between pixel currents and voltages on the power supply line.

An examination of the geometry in FIG. 6 shows us that the current change is given by:

$$\Delta I = \frac{dI_{TFT}}{dV}\Delta V - \frac{dI_{TFT}}{dV}\Delta V_a \tag{2}$$

where $\Delta V_a$ is the change in LED anode voltage shown in FIG. 4, and the differential is simply the gradient of the TFT characteristic λ(I). The LED characteristic is given by $I_{LED}=f(V_a)$ so we find $\Delta V_a$ by differentiating the LED characteristic i.e.

$$\Delta I = \frac{df}{dV}\Delta V_a = \mu(I)\Delta V_a \tag{3}$$

using equations (2) and (3):

$$\Delta I = \frac{\lambda(I)}{\left(1 + \frac{\lambda(I)}{\mu(I)}\right)}\Delta V \tag{4}$$

For the purpose of this analysis it can be assumed that the current dependence of these parameters is dependent upon the current I(r). Therefore, by substituting (4) into (1a):

$$I_{av}(r) = I(r) + \frac{1}{N}\frac{\lambda(I(r))}{\left(1 + \frac{\lambda(I(r))}{\mu(I(r))}\right)}\sum_{j=r+1}^{r+N-1} \Delta V(r, j) \tag{5}$$

The change in voltage is given by $$\Delta V(r,j)=V(r,r)-V(r,j) \tag{6}$$

where V(r,r) is the power line voltage drop at row r when row r is addressed and V(r,j) is the power line voltage drop at row r when row j is addressed.

The analysis below assumes that the power line is held at a fixed voltage at the top and bottom. However, it will be appreciated than the analysis can however be performed for a power supply column held at one end. Thus, in this analysis, the power line is assumed to comprise a column that has voltage sources at both ends of the column to supply current to every pixel in the column. Initially, it can be assumed that every pixel contains a perfect current source drawing current from the power line and providing it to the OLED. The equivalent circuit for the model is shown in FIG. 6.

The following expression can be derived for the current to the pixel at row r in terms of the voltages on the power line at rows r−1, r and r+1. The resistance of the power line between nodes is R.

$$\begin{aligned} I(r) &= \frac{1}{R}(V(r-1) - V(r)) + \frac{1}{R}(V(r+1) - V(r)) \\ &= \frac{1}{R}(V(r-1) - 2V(r) + V(r+1)) \end{aligned} \tag{7}$$

The current I(r) is known as this has been programmed into the pixel current source so the need is to solve (1) for the voltage V(r) to calculate the power line voltage drops. Writing out all the terms:

$$I(0)R=V_T-2V(0)+V(1)$$

$$I(1)R=V(0)-2V(1)+V(2)$$

$$I(N-1)R=V(N-2)-2V(N-1)+V_B$$

Where $V_T$ and $V_B$ are the voltage sources at the top and bottom of the power line. Then in matrix form:

$$RI=M.V+V_b \tag{8}$$

where $$I(j)=\begin{bmatrix} I(0,j) \\ I(1,j) \\ \vdots \\ I(r,j) \\ \vdots \\ (W+1)I(j,j) \\ I(j+1-N,j) \\ \vdots \\ I(-1,j) \end{bmatrix},\quad V(j)=\begin{bmatrix} V(0,j) \\ V(1,j) \\ \vdots \\ V(r,j) \\ \vdots \\ V(j,j) \\ V(j+1,j) \\ \vdots \\ V(N-1,j) \end{bmatrix}\quad V_b=\begin{bmatrix} V_T \\ 0 \\ \vdots \\ 0 \\ V_B \end{bmatrix}$$

and $$M=\begin{bmatrix} -2 & 1 & & & \\ 1 & -2 & 1 & & \\ & \ddots & \ddots & \ddots & \\ & & 1 & -2 & 1 \\ & & & 1 & -2 \end{bmatrix}$$

Vectors I and V above are indexed by j to indicate that these are the currents and voltages on the power column when row j is addressed. Note that the $j^{th}$ element in vector I is multiplied by (W+1) to indicate that the addressing current is also been drawn from the power column. Thus, during addressing, an additional current of W times the addressing current is drawn. W=1 if the addressing phase results in doubling of the current drawn during addressing, which is the case for a matched mirror circuit with identical sampling and drive transistors.

The voltages on the power supply line are found by inverting equation (8) i.e.

$$V(j)=M^{-1}(RI(j)-V_b) \tag{9}$$

For a given size matrix M, the inverse can be obtained simply by standard mathematical techniques. In particular, the matrix M is a tridiagonal symmetrical matrix, and the inverse is easily obtained, as $$M^{-1}=-\frac{1}{N+1}\begin{bmatrix} N & (N-1) & (N-2) & \cdots & 3 & 2 & 1 \\ (N-1) & 2(N-1) & 2(N-2) & & 6 & 4 & 2 \\ (N-2) & 2(N-2) & 3(N-2) & & 9 & 6 & 3 \\ \vdots & & & \ddots & & & \vdots \\ 3 & 6 & 9 & & 3(N-2) & 2(N-2) & (N-2) \\ 2 & 4 & 6 & & 2(N-2) & 2(N-1) & (N-1) \\ 1 & 2 & 3 & \cdots & (N-2) & (N-1) & N \end{bmatrix}$$

Also, computing the result of $M^{-1}$ on vector $V_b$ gives the result $$\sum_{j=0}^{N-1} M^{-1}(n,j)V_b(j)=\frac{1}{N+1}\{(N-n)V_T+(n+1)V_B\} \tag{9a}$$

which simplifies to V when $V_T=V_B=V$.

Therefore:

$$V(r,r)=R\left[WM^{-1}(r,r)I(r,r)+\sum_{k=0}^{N-1}M^{-1}(r,k)I(k,r)\right]$$

$$V(r,j)=R\left[WM^{-1}(r,j)I(j,j)+\sum_{k=0}^{N-1}M^{-1}(r,k)I(k,j)\right]$$

where $M^{-1}(r,k)$ are matrix elements of $M^{-1}$. In these equations, the constants resulting from the multiplication $M^{-1}.V_b$ are ignored, as the equations are then used to derive difference voltages, so that the constants cancel out. The voltage differences are then given by:

$$\Delta V(r,j)=R\begin{bmatrix} W(M^{-1}(r,r)I(r,r)-M^{-1}(r,j)I(j,j))+ \\ \sum_{k=0}^{N-1}M^{-1}(r,k)(I(k,r)-I(k,j)) \end{bmatrix} \tag{10}$$

Vertical cross-talk can be considered to be at its most visible when the image is static from one field to the next. For moving images, the movement disguises the cross talk. The mathematical analysis for the compensation of cross talk for static images is more easily carried out, and this analysis is given below. However, it is possible to carry out a different analysis to arrive at a slightly different cross talk correction scheme. The invention encompasses all of the different possible correction schemes, provided the compensation takes into account the column power supply line voltage at each pixel and the dependency of the pixel brightness characteristics on the voltage on the column power supply line at the pixel.

Mathematically the static field condition is represented by:

$$I(r,j)=I(r-N,j)$$

i.e. the pixel current in the current field is equal to the current in the previous field. This will mean that vectors I(r) and I(j) become $$I(r)=\begin{bmatrix} I(0,r) \\ I(1,r) \\ \vdots \\ (W+1)I(r,r) \\ I(r+1,r) \\ \vdots \\ I(N-1,r) \end{bmatrix},\quad I(j)=\begin{bmatrix} I(0,j) \\ I(1,j) \\ \vdots \\ (W+1)I(j,j) \\ I(j+1,j) \\ \vdots \\ I(N-1,j) \end{bmatrix}$$

The second index in the current no longer matters because (to a first approximation, ignoring the effect of cross-talk) the current in the pixel on line r is the same in both fields no matter what line is being addressed. Hence $$\Delta V(r,j)=WR(M^{-1}(r,r)I(r)-M^{-1}(r,j)I(j)) \tag{11}$$

Therefore the vertical cross-talk is given by $$\begin{aligned} I_{av}(r) &= I(r)+\frac{1}{N}\frac{\lambda(I(r))}{\left(1+\frac{\lambda(I(r))}{\mu(I(r))}\right)} \sum_{j=r+1}^{r+N-1} WR(M^{-1}(r,r)I(r)-M^{-1}(r,j)I(j)) \\ &= I(r)+\frac{RW\lambda(I(r))}{\left(1+\frac{\lambda(I(r))}{\mu(I(r))}\right)}\left(M^{-1}(r,r)I(r)-\frac{1}{N}\sum_{j=0}^{N-1}M^{-1}(r,j)I(j)\right) \end{aligned} \tag{12}$$

To perform a correction we need to find currents I(r) that will result in an image without vertical cross-talk. This requires the inversion of equation (12) i.e. solve (12) for I(r). This is a non-linear problem that is very difficult to solve, to enable a solution we assume that $\lambda(I)$ and $\mu(I)$ are functions of $I_{av}$ rather than I i.e. $\lambda(I_{av})$ and $\mu(I_{av})$. If we represent equation (12) in a vector matrix form then a solution can be seen.

$$I_{av}=I+RWD\left(M_D^{-1}I-\frac{1}{N}M^{-1}I\right) \tag{13}$$

The term $$D=\frac{\lambda(I_{av})}{\left(1+\frac{\lambda(I_{av})}{\mu(I_{av})}\right)}$$

is a diagonal matrix and $M^{-1}{}_D$ is also a diagonal matrix containing the diagonal terms in matrix $M^{-1}$. Then we can solve for I $$\begin{aligned} I &= \left(1+RWD\left(M_D^{-1}-\frac{1}{N}M^{-1}\right)\right)^{-1}I_{av} \\ &\approx I_{av}-RWD\left(M_D^{-1}I_{av}-\frac{I}{N}M^{-1}I_{av}\right) \end{aligned} \tag{14}$$

Equation (14) represents the currents required to approximately remove vertical cross-talk. The calculation has to be performed for every column in the display.

This analysis is for a matched current mirror circuit, but the constant W allows the analysis to cover different types of circuit giving different current drawing characteristics during addressing.

An implementation of the invention will now be described. Essentially, this implementation requires calculation of the terms making up equation (14). This calculation is carried out in steps:

Step 1

This requires the calculation of $M^{-1}I_{av}$.

The implementation of $M^{-1}I_{av}$ could in general be a very computationally expensive calculation, especially for large images. Therefore a fast method of performing the calculation is essential. As seen above, the calculation of $M^{-1}I_{av}$ requires the evaluation of the sums shown below (index c is the column number):

$$F(c,n)=\sum_{j=0}^{n-1}(n-j)I_{av}(c,j)-\frac{n+1}{N+1}\sum_{j=0}^{N-1}(N-j)I_{av}(c,j) \tag{15}$$

By calculating the difference of F(c,n) and F(c,n−1) a recursive relation for the elements F(c,n) can be found:

$$\begin{aligned} F(c,n) &= \sum_{j=0}^{n-1}(n-j)I_{av}(c,j)-\frac{n+1}{N+1}\sum_{j=0}^{N-1}(N-j)I_{av}(c,j) \\ F(c,n-1) &= \sum_{j=0}^{n-2}(n-1-j)I_{av}(c,j)-\frac{n}{N+1}\sum_{j=0}^{N-1}(N-j)I_{av}(c,j) \end{aligned}$$

By expanding the subtraction F(c,n)−F(c,n−1), the following recursive relation is obtained:

$$F(c,n)=F(c,n-1)+\sum_{j=0}^{n-1}I_{av}(c,j)+F(c,0) \tag{16}$$

where $$F(c,0)=\frac{-1}{N+1}\sum_{j=0}^{N-1}(N-j)I_{av}(c,j) \tag{17}$$

This calculation is required on all columns of the display.

If we call the term in brackets in equation (14) B(c,n) then $$B(c,n)=\begin{cases} F(c,n)-F(c,n)/N & \text{if } c=n \\ -F(c,n)/N & \text{if } c\neq n \end{cases}$$

This can be seen when considering that $M^{-1}{}_D$ has only diagonal entries, which are those of the matrix $M^{-1}$.

Figure 7:
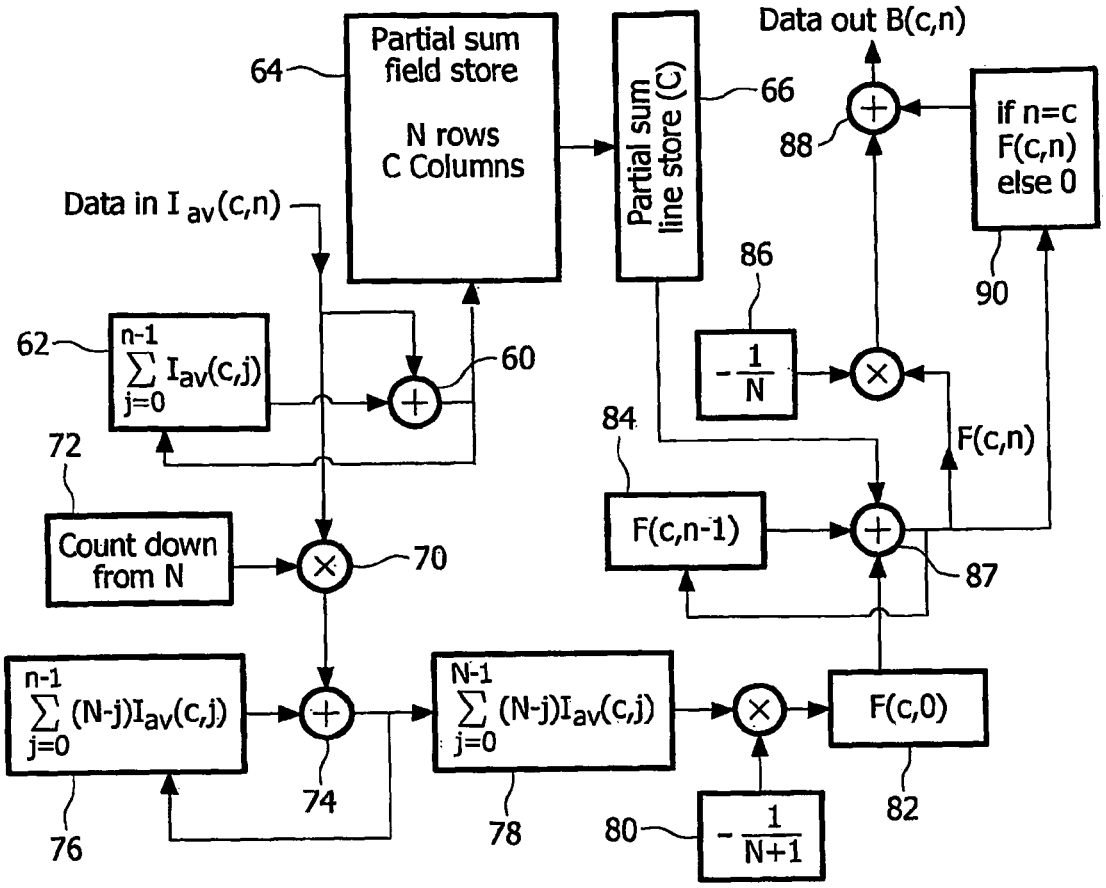
FIG. 7 shows circuitry for implementing part of a first example of method of the invention.

FIG. 7 shows the hardware to calculate the vector-matrix multiplication. The input data is fed to an adder 60 whose second input is from a line store 62 addressed by a counter counting the row number (j). Each value in the line store 62 contains a running sum of the previous data values on the column for a particular column. This line store will be zero after each field of data. The output of the sum is passed back to the line store 62 to overwrite the pervious value stored at the location addressed. It is also passed to a field store 64 with rows 0 to N−1 and columns 0 to C−1. The field store is addressed by a line counter counting the value c from 0 to C−1, where c is the pixel number within a line (row) and a row counter counting the value n from 0 to N−1, where n is the line (row) number. The values of c and n determine the location of the partial sum. At the end of a field time the partial sum data is transferred in parallel a row at a time to a line store 66, and this data will be used in the computation of equation (16).

The input data is also fed to a multiplier 70 whose second input comes from a counter 72 that counts down from N at the start of a field and increments every line time. The output of the multiplier is passed to an adder 74 whose second input comes from a line store 76 whose elements contains the running sums of the earlier inputs to the multiplier for every column. This line store 76 is set to zero at the beginning of a field time. A counter counting the pixel number within a line again addresses the line store 76.

The output of the adder 74 is fed back to the addressed location of the line store 76 to overwrite the previous value. At the end of the field, the values in the line store 76, which is then the full summation value shown in box 78, are all multiplied by the same constant −1/(N+1) which is stored as shown at 80. The result is written to another line store 82. The results stored in the line store 82 are the values F(c,0) of equation (16).

The value F(c,0) is thus available, and the partial sum data required to calculate F(c,n).

The calculation of F(c,n) is achieved by addressing the line store 82 containing F(c,0) and the line store 66 containing the partial sum data and adding the data to the output of a further line store 84 containing F(c,n−1). The result, at the output of adder 87, constitutes F(c,n) and is also written back into the addressed location of the F(c,n−1) line store to overwrite the stored value.

This summed value is then multiplied by the constant −1/N stored in block 86 and passed to another adder 88. The second input to the adder 88 comes from a decision block 90, if n=c then the value F(c,n) is passed to the adder, otherwise zero is passed.

The output of the adder 88 is the result of this processing block B(c,n) and corresponds to the terms in brackets in equation 14.

Step 2

Figure 8:
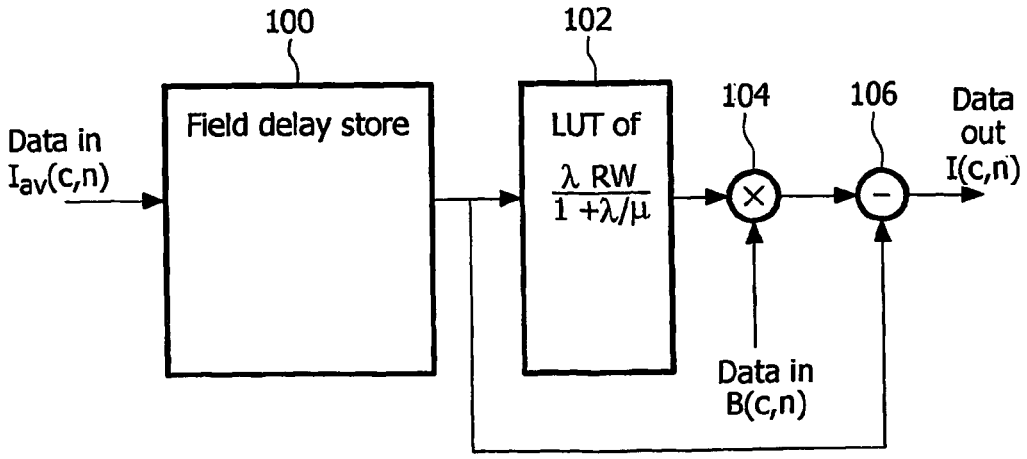
FIG. 8 shows circuitry for implementing another part of the first example of method of the invention.

The remaining parts of the algorithm can be implemented as shown in FIG. 8. The input data passes through a field delay store 100 and onto a look up table (LUT) 102 to find the value of $WR\lambda/(1+\lambda/\mu)$ corresponding to that input data value. The output of the field store is also passed to the subtraction unit 106. The output of the LUT 102 is multiplied by the output of step 1 (B(c,n)) and also passed to the subtraction unit 106. The result is then the corrected data.

This data processing will fit into the total video processing chain, preferably at the end of the processing chain, namely after all other data modifications have been performed.

As the OLED characteristic will vary according to temperature and age will also be possible to update the LUT 102 of FIG. 8 with new values to represent these changes. The LUT will need changing for different types of AMOLED display through parameter W e.g. matched TFT to driving TFT width, or if the row resistance R changes for different manufactures or for different TFT output impedance characteristics. Therefore the LUT will need to be accessible and updateable.

The above analysis is for a current mirror type circuit. There are other circuits and addressing schemes which can benefit from the compensation scheme of the invention. These addressing techniques may use different techniques to avoid cross-talk that occurs from the corruption of the in-pixel data voltage. However cross-talk will still appear due to the TFT output impedance. Generally, addressing schemes have an addressing phase and a light emission phase, and this is to stop current flowing on the power lines when the pixels are being addressed. Cross-talk again results from addressing a display in this manner as a result of the currents flowing along the power column.

The technique of the invention is thus not limited to current addressed pixels, but can be used more generally whenever a column power supply line is used. The invention can be applied to voltage-addressed pixels using column power lines, and these pixels may have other compensation measures already integrated into the pixel design. The invention provides modified target currents for the pixels. In the case of current-addressed pixels, this means the currents used to address the pixels are then changed. In the case of voltage addressed pixels, the modified target currents are then converted back to voltage drive levels for the pixels, for example using the basic model of the pixel characteristics.

A simplified correction scheme can be derived from equation (4) above. In the general case, it can be assumed that the current drawn during addressing is $\alpha I$ where I is the addressing current. For a scheme where no current flows during addressing, $\alpha=0$, and a simplified algorithm can be derived, as will shown below.

If the initial voltages on the power line are caused by addressing currents $\alpha I$ there are voltage drops in the addressing period of $$V_i = M^{-1}(\alpha RI - V_b) \tag{18}$$

if after addressing, the currents are I, then the power line voltage drops become $$V_f = M^{-1}(RI - V_b) \tag{19}$$

therefore the difference in power line voltages are $$\Delta V = (1-\alpha)RM^{-1}I \tag{20}$$

Example values for $\alpha$ are zero for modified current source and voltage threshold measurement circuits, 1 for switched current mirrors (i.e. no cross-talk, but these pixel circuits are unsuitable for large displays), and greater than or equal to two for matched current mirror circuits. The greater than two case will occur if the matched TFT is wider than the driving TFT.

The initial currents $I_0$ on the row (after addressing) will cause a voltage drop of $\Delta V$ which in turn will cause $I_0$ to change to $I_1$ which will change the voltage drops which will change the current and so on. It is expected that $\lambda$ will be very small so a first order approximation is sufficient i.e.

$$I_1 = I_0 + \frac{\lambda(I_0)}{\left(1 + \frac{\lambda(I_0)}{\mu(I_0)}\right)}(1-\alpha)RM^{-1}I_0 \tag{21}$$

It can again be assumed that $\mu$ and $\lambda$ depend upon the known current $I_1$. This will be a good approximation if the current changes between $I_1$ and $I_0$ are small. The solution of equation (21) is then:

$$I_0 = \left(1 + \frac{\lambda(I_1)}{\left(1 + \frac{\lambda(I_1)}{\mu(I_1)}\right)}(1-\alpha)RM^{-1}\right)^{-1} I_1 \approx I_1 - \frac{\lambda(I_1)}{\left(1 + \frac{\lambda(I_1)}{\mu(I_1)}\right)}(1-\alpha)RM^{-1}I_1 \tag{22}$$

Assuming $\alpha=0$, in order to show a simplified algorithm solution:

$$I_0 \approx I_1 - \frac{\lambda(I_1)}{\left(1+\frac{\lambda(I_1)}{\mu(I_1)}\right)} RM^{-1} I_1 \tag{23}$$

$I_1$ is the input data and $I_0$ is the corrected data. The hardware implementation for this case ($\alpha=0$) is very similar to that above for the matched current mirror (typically $\alpha=1$), and is shown in FIGS. 9 and 10 using the same references as in FIGS. 7 and 8.

Figure 9:
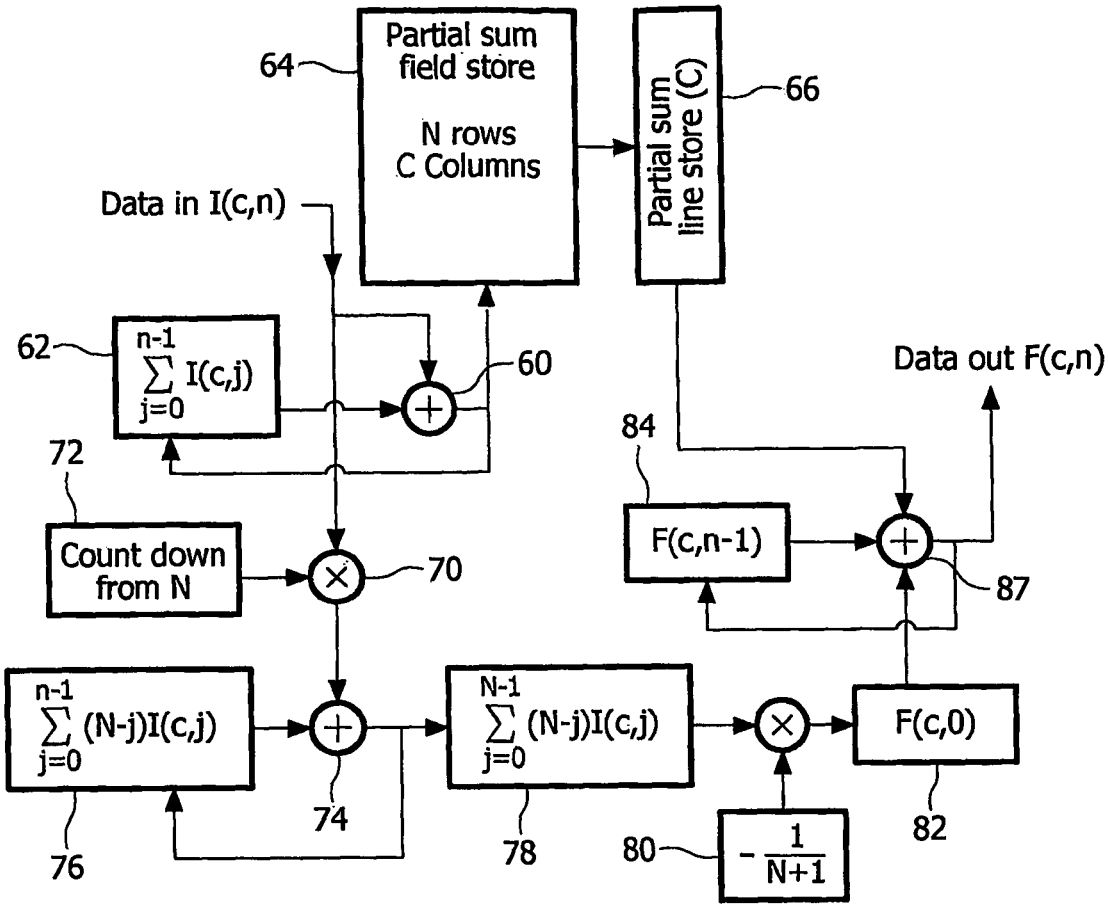
FIG. 9 shows circuitry for implementing part of a second example of method of the invention.
Figure 10:
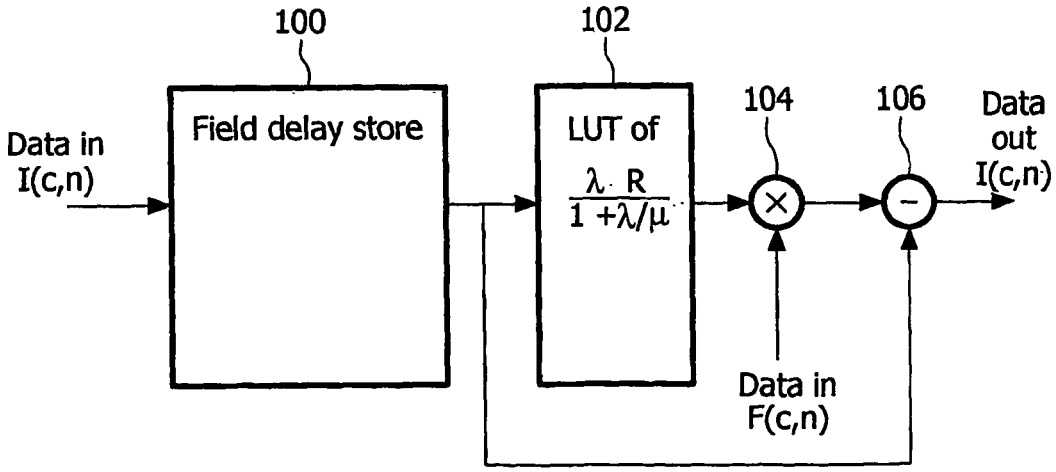
FIG. 10 shows circuitry for implementing another part of the second example of method of the invention.

In FIG. 9, the output of the circuit for "step 1" is the value F(c,n), namely the output of adder 87. There is no need for the logic element 90 and associated adder and multiplier. The values of F(c,n) can then be provided to the multiplier 104 in FIG. 10. The LUT 102 in FIG. 10 no longer uses the parameter "W".

The AMOLED display is typically constructed with additional pixel circuits outside the array and which are used for testing purposes. These may take the form shown in FIG. 11, and essentially model the behaviour of the drive transistor characteristics and of the row conductor resistance. These dummy pixel circuits have been proposed for use in threshold compensation schemes. The use of these dummy pixel circuits makes it possible to automatically generate and update the LUT over the lifetime of the display.

Figure 11:
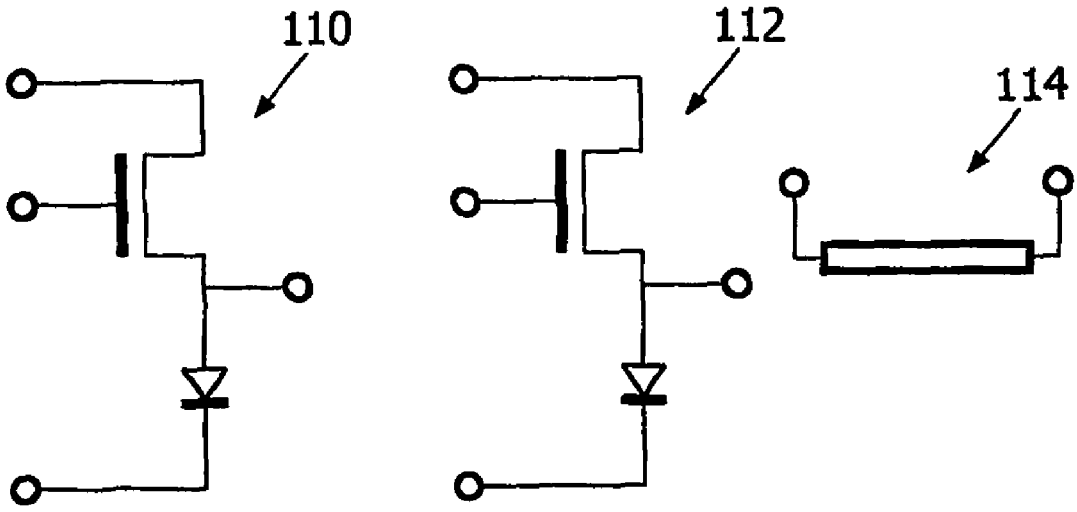
FIG. 11 shows dummy pixel circuits for use in a display of the invention.

FIG. 11 shows a dummy pixel 110 with an n-type transistor, a dummy pixel 112 with a p-type transistor and a resistor 114 which can be used to model the row conductor characteristics. Each circuit has terminals which allow test signals to be applied and outputs to be monitored. The PCMs shown in FIG. 11 are on the glass. There will be an n-type circuit for amorphous silicon circuits and a p-type circuit for low temperature polysilicon (LTPS) circuits or a combination of n-type and p-type circuits for LTPS circuits.

The TFT output impedance as a function of current can be measured by varying the gate-source voltage of the TFT and measuring the current and the drain-source voltage of the TFT from the appropriate probe points on the circuit. Then the gradient of the data will be required to give $\lambda$. The same can be achieved for the OLED to give $\mu$. R can be determined by passing a current through a strip of metal N pixel lengths long and measuring the voltage to calculate the resistance in a pixel width strip of power line metal.

The display type will be dictate the value W in the example of matched current mirror circuit above. All of this information enable the LUT to be calculated and updated through the lifetime of the display. The hardware to perform the measurements is straightforward and would possibly be included within the display driver chips. These would feed back the measured data to hardware in a controller chip to calculate the LUT and fill it.

Only one detailed algorithm has been given, and some assumptions have been made to simplify the implementation of the method. Other assumptions may be made to arrive at a different algorithmic implementation, and the invention is not limited to the specific implementation described above.

The hardware example has been described as having numerous registers and logic elements. Many or all of the elements can be integrated into a dedicated processor architecture, and the hardware example is only one way of implementing the correction scheme of the invention.

Other modifications will be apparent to those skilled in the art.

The invention claimed is:

1. A display device comprising an array of light emitting display elements (2) arranged in rows and columns, with a plurality of pixels in a column being supplied with current from a respective column power supply line (26) and the pixels being addressed row by row, the addressing of all rows defining a field period, the device further comprising:

compensation circuitry for modifying target pixel drive currents corresponding to desired pixel brightness levels, to take account of the voltage on the column power supply line at each pixel resulting from the currents drawn from the column power supply line by the plurality of pixels in the column being supplied by the column power supply line for each row addressing cycle in a field period and the dependency of pixel brightness characteristics on a voltage on a row conductor at the pixel and independent changes in the drain and source voltages of the drive transistor.

2. A device as claimed in claim 1, wherein the compensation circuitry comprises: means for applying an algorithm to the target pixel drive currents which represents a relationship between the currents drawn by the plurality of pixels in a column and the voltages on the column power supply line at the locations of the pixels and the dependency of the pixel brightness characteristics on the voltage on the row conductor.

3. A device as claimed in claim 2, wherein the means for applying an algorithm derives values corresponding to multiplying a vector of the target pixel drive currents for a column of pixels by the inversion of a matrix M, in which:

$$M = \begin{bmatrix} -2 & 1 & & & \\ 1 & -2 & 1 & & \\ & \ddots & \ddots & \ddots & \\ & & 1 & -2 & 1 \\ & & & 1 & -2 \end{bmatrix},$$

and wherein the number of rows and columns of matrix M is equal to the number of pixels in the column.

4. A device as claimed in claim 2, wherein each of the plurality of pixels in a column comprises a current sampling transistor (34) which samples an input current and provides a drive voltage to a drive transistor (22), and wherein the algorithm uses a value including terms derived from:

the voltage-current characteristics of the drive transistor (22); and the voltage-current characteristics of the light emitting display element (2).

5. A device as claimed in claim 4, wherein the drive transistor (22) and the light emitting display element (2) of each of the plurality of pixels in a column are in series between the column power supply line (26) and a common line.

6. A device as claimed in claim 2, wherein the algorithm uses a value including a term (R) derived from a resistance of the column power supply line (26).

7. A device as claimed in claim 6, wherein the algorithm uses a value $R\lambda/(1+\lambda/\mu)$, where R is the resistance of the column power supply line between adjacent pixels;

$\lambda$ is the slope of the drain-source current vs. drain-source voltage curve of the drive transistor; and $\mu$ is the slope of the current vs. voltage curve of the display element.

8. A device as claimed in claim 7, wherein the value $R\lambda/(1+\lambda/\mu)$ uses the slope of the drain-source current vs. drain-source voltage curve of the drive transistor and the slope of the current vs. voltage curve of the display element at a target pixel drive current.

9. A device as claimed in claims 3, wherein the means for applying an algorithm derives values by a recursive operation $$F(c, n) = F(c, n-1) + \sum_{j=0}^{n-1} I_{av}(c, j) + F(c, 0)$$

in which:

F(c,n) is the nth term of the vector result of multiplying the vector of target pixel drive currents for the cth column of pixels by the inversion of the matrix M, F(c, 0) being the first term; and I(c,j) is a target pixel drive current for the jth pixel in the cth column, the first pixel being j=0.

10. A device as claimed in claim 9, wherein:

$$F(c, 0) = \frac{-1}{N+1} \sum_{j=0}^{N-1} (N-j) I_{av}(c, j),$$

in which:

N is the total number pixels in the column.

11. A device as claimed in claim 2, wherein the means for applying an algorithm comprises a look up table (102).

12. A device as claimed in claim 11, further comprising at least one pixel compensation module (110,112,114), and further comprising means for updating the values of the look up table to enable changes in pixel brightness characteristics over time to be modeled based on analysis of the characteristics of the pixel compensation module.

13. A circuit for generating pixel drive currents for the display elements of a light emitting display device having display elements arranged in rows and columns, with a plurality of pixels in a column being supplied with current from a respective column power supply line (26) and the plurality of pixels being addressed row by row, the addressing of all rows defining a field period, the circuit comprising:

means for receiving target pixel drive currents;

compensation circuitry for modifying target pixel drive currents to take account of the voltage on the column power supply line at each of the plurality of pixels in the column resulting from the currents drawn from the column power supply line by the plurality of pixels in the column for each row addressing cycle in a field period and the dependency of pixel brightness characteristics on the voltage on a row conductor at the pixel and independent changes in the drain and source voltages of the drive transistor.

14. A circuit as claimed in claim 13, wherein the compensation circuitry comprises:

means for applying an algorithm to the target pixel drive currents which represents a relationship between the currents drawn by the pixels in a column and voltages on the column power supply line at the locations of the pixels in the column and the dependency of the pixel brightness characteristics on the voltage on the row conductor.

15. A circuit as claimed in claim 14, wherein the means for applying an algorithm derives values corresponding to multiplying a vector of target pixel drive currents for a column of pixels by the inversion of a matrix M, in which:

$$M = \begin{bmatrix} -2 & 1 & & & \\ 1 & -2 & 1 & & \\ & \ddots & \ddots & \ddots & \\ & & 1 & -2 & 1 \\ & & & 1 & -2 \end{bmatrix},$$

and wherein the number of rows and columns of matrix M is equal to the number of pixels in the column.

16. A circuit as claimed in claim 15, wherein the algorithm uses a value including a term (R) derived from the resistance of the column power supply line (26).

17. A circuit as claimed in claim 15, wherein the means for applying an algorithm derives values by a recursive operation $$F(c, n) = F(c, n-1) + \sum_{j=0}^{n-1} I_{av}(c, j) + F(c, 0)$$

in which:

F(c,n) is the nth term of the vector result of multiplying the vector of target pixel drive currents for the cth column of pixels by the inversion of the matrix M, F(c,0) being the first term; and I(c,j) is a target current for the jth pixel in the cth column, the first pixel being j=0.

* * * * *